US008385505B2

(12) United States Patent
Coon et al.

(10) Patent No.: US 8,385,505 B2
(45) Date of Patent: Feb. 26, 2013

(54) X-RAY TUBE BEARING ASSEMBLY

(75) Inventors: Ward Vincent Coon, Salt Lake City, UT (US); Dennis Runnoe, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/488,423

(22) Filed: Jun. 19, 2009

(65) Prior Publication Data

US 2010/0322383 A1 Dec. 23, 2010

(51) Int. Cl.
*H01J 35/12* (2006.01)
*H01J 35/10* (2006.01)
*H01J 35/02* (2006.01)

(52) U.S. Cl. ..... 378/127; 378/130

(58) Field of Classification Search ..... 378/119, 378/121, 125, 127–130, 132, 133, 141–144
See application file for complete search history.

(56) References Cited

U.S. PATENT DOCUMENTS

| | | | | | |
|---|---|---|---|---|---|
| 3,608,383 | A * | 9/1971 | Hunter et al. | ..... | 74/5.6 D |
| 4,468,801 | A * | 8/1984 | Sudo et al. | ..... | 378/132 |
| 4,628,522 | A * | 12/1986 | Ebersberger | ..... | 378/132 |
| 4,679,220 | A * | 7/1987 | Ono | ..... | 378/132 |
| 4,811,375 | A * | 3/1989 | Klostermann | ..... | 378/131 |
| 4,891,832 | A * | 1/1990 | Ebersberger | ..... | 378/132 |
| 4,964,148 | A * | 10/1990 | Klostermann et al. | ..... | 378/127 |
| 5,117,448 | A * | 5/1992 | Penato et al. | ..... | 378/132 |
| 5,357,552 | A * | 10/1994 | Kutschera | ..... | 378/132 |
| 5,506,881 | A * | 4/1996 | Ono et al. | ..... | 378/125 |
| 5,588,035 | A * | 12/1996 | Christean et al. | ..... | 378/132 |
| 5,729,066 | A * | 3/1998 | Soong et al. | ..... | 310/90.5 |
| 6,078,120 | A * | 6/2000 | Casaro et al. | ..... | 310/90.5 |
| 6,198,803 | B1 * | 3/2001 | Osama et al. | ..... | 378/132 |
| 6,327,340 | B1 * | 12/2001 | Runnoe | ..... | 378/130 |
| 6,430,262 | B1 * | 8/2002 | Panasik et al. | ..... | 378/132 |
| 6,752,005 | B2 * | 6/2004 | Harada et al. | ..... | 73/35.13 |

FOREIGN PATENT DOCUMENTS

| | | |
|---|---|---|
| EP | 151878 | 8/1985 |
| JP | 1 319234 | 12/1989 |
| JP | 2009 021161 | 1/2009 |

OTHER PUBLICATIONS

Robert A F Zwijze et al: "Low-cost piezoresistive silicon load cell independent of force distribution; Low-cost piezoresistive silicon load cell", Journal of Micromechanics & Microengineering, Institute of Physics Publishing Bristol, GB, vol. 10, No. 2, Jun. 1, 2000, pp. 200-203, XP020068555, ISSN: 0960-1317, DOI: 10.1088/0960-1317/10/2/317.

Chen J S et al: "Bearing load analysis and control of a motorized high speed spindle", International Journal of Machine Tools and Manufacture, Elsevier, US, vol. 45, No. 12-13, Oct. 1, 2005, pp. 1487-1493, XP027815567, ISSN: 0890-6955.

European Search Report mailed Jun. 21, 2012 in related European Patent Application No. 10166524.8.

* cited by examiner

*Primary Examiner* — Anastasia Midkiff
(74) *Attorney, Agent, or Firm* — Maschoff Gilmore & Israelsen

(57) ABSTRACT

In one example, an x-ray tube comprises an evacuated enclosure and a cathode disposed within the evacuated enclosure. An anode is also disposed within the evacuated enclosure opposite the cathode so as to receive electrons emitted by the cathode. A rotor sleeve is coupled to the anode, the rotor sleeve being responsive to applied electromagnetic fields such that a rotational motion is imparted to the anode. A magnetic assist bearing assembly rotatably supports the anode.

28 Claims, 7 Drawing Sheets

X-RAY TUBE BEARING ASSEMBLY

BACKGROUND OF THE INVENTION

1. The Field of the Invention

The present invention generally relates to rotating machinery. In particular, some example embodiments relate to an x-ray tube bearing assembly including magnetic bearing assembly components and ball bearing assembly components.

2. The Related Technology

The x-ray tube has become essential in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes a vacuum enclosure that contains a cathode assembly and an anode assembly. The vacuum enclosure may be composed of metal such as copper, glass, ceramic, or a combination thereof, and is typically disposed within an outer housing. At least a portion of the outer housing may be covered with a shielding layer (composed of, for example, lead or a similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating the coolant to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a target surface that is oriented to receive electrons emitted by the cathode assembly.

During operation of the x-ray tube, the cathode is charged with a heating current that causes electrons to "boil" off the electron source or emitter by the process of thermionic emission. An electric potential on the order of about 4 kV to over about 116 kV is applied between the cathode and the anode in order to accelerate electrons boiled off the emitter toward the target surface of the anode. X-rays are generated when the highly accelerated electrons strike the target surface.

In a rotating anode-type x-ray tube, the anode is supported by a bearing assembly that allows the anode to rotate within the x-ray tube. One type of bearing assembly sometimes used in x-ray tubes is a ball bearing assembly. While conventional ball bearing assemblies can be relatively inexpensive, they can also be relatively noisy and the noise can be a source of discomfort or irritation for medical patients and other x-ray tube users and operators. Another type of bearing assembly sometimes used in x-ray tubes is a magnetic bearing assembly. While conventional magnetic bearing assemblies can be relatively quiet, they can also be relatively expensive, increasing the cost of x-ray tubes in which they are used.

Further, a substantial amount of heat can be generated in rotating anode-type x-ray tubes from the high electrical power used to operate the x-ray tubes. For example, rotating anodes in some x-ray tubes may regularly experience temperatures exceeding 1200° C. due, at least in part, to the impingement of the highly accelerated electrons on the rotating anode. The high temperatures can cause shifting of portions of the anode, cracking, distressing, warping, and other material failures. Material failures can result in errors in the resultant x-ray image. Consequently, heat must be managed in many x-ray tubes The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF SOME EXAMPLE EMBODIMENTS

In general, example embodiments of the invention relate to an x-ray tube bearing assembly including magnetic and ball bearing components.

In one example embodiment, an x-ray tube comprises an evacuated enclosure and a cathode disposed within the evacuated enclosure. An anode is also disposed within the evacuated enclosure opposite the cathode so as to receive electrons emitted by the cathode. A rotor sleeve is coupled to the anode, the rotor sleeve being responsive to applied electromagnetic fields such that a rotational motion is imparted to the anode. A magnetic assist bearing assembly rotatably supports the anode.

In another example embodiment, an active magnetic assist bearing assembly comprises a ball bearing assembly, means for detecting, and one or more magnetic actuators. The ball bearing assembly comprises a shaft coupled to a component configured to rotate. The ball bearing assembly shoulders a first portion of a load exerted by the component on the active magnetic assist bearing assembly during rotation of the component. The means for detecting detect a load exerted on the active magnetic assist bearing assembly by the component. The magnetic actuators are disposed about a rotor sleeve that is coupled to the component. The magnetic actuators shoulder a second portion of the load during rotation of the component.

In another example embodiment, an x-ray tube comprises an evacuated enclosure and a cathode disposed within the evacuated enclosure. An anode is also disposed within the evacuated enclosure opposite the cathode so as to receive electrons emitted by the cathode. The anode defines a cavity extending from the top of the anode towards the bottom of the anode. The cavity is substantially centered about a geometric axis of rotation of the anode. A rotor sleeve is coupled to the anode and is responsive to applied electromagnetic fields such that a rotational motion is imparted to the anode. An active cooling system is at least partially disposed within the evacuated enclosure. The active cooling system comprises a cooling shaft extending into the cavity defined by the anode.

In yet another example embodiment, a passive magnetic assist bearing assembly comprises a ball bearing assembly, a ferromagnetic shaft, and one or more permanent magnets. The ball bearing assembly comprises a shaft coupled to a component configured to rotate. The ball bearing assembly shoulders a first portion of a load exerted by the component on the passive magnetic assist bearing assembly during rotation of the component. The ferromagnetic shaft is coupled to the component and has an axis of rotation that is substantially collinear with an axis of rotation of the component. The one or more permanent magnets are spaced apart from the ferromagnetic shaft. The one or more permanent magnets utilize magnetic fields to exert magnetic forces on the ferromagnetic shaft to shoulder a second portion of the load during rotation of the component.

These and other aspects of example embodiments of the invention will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
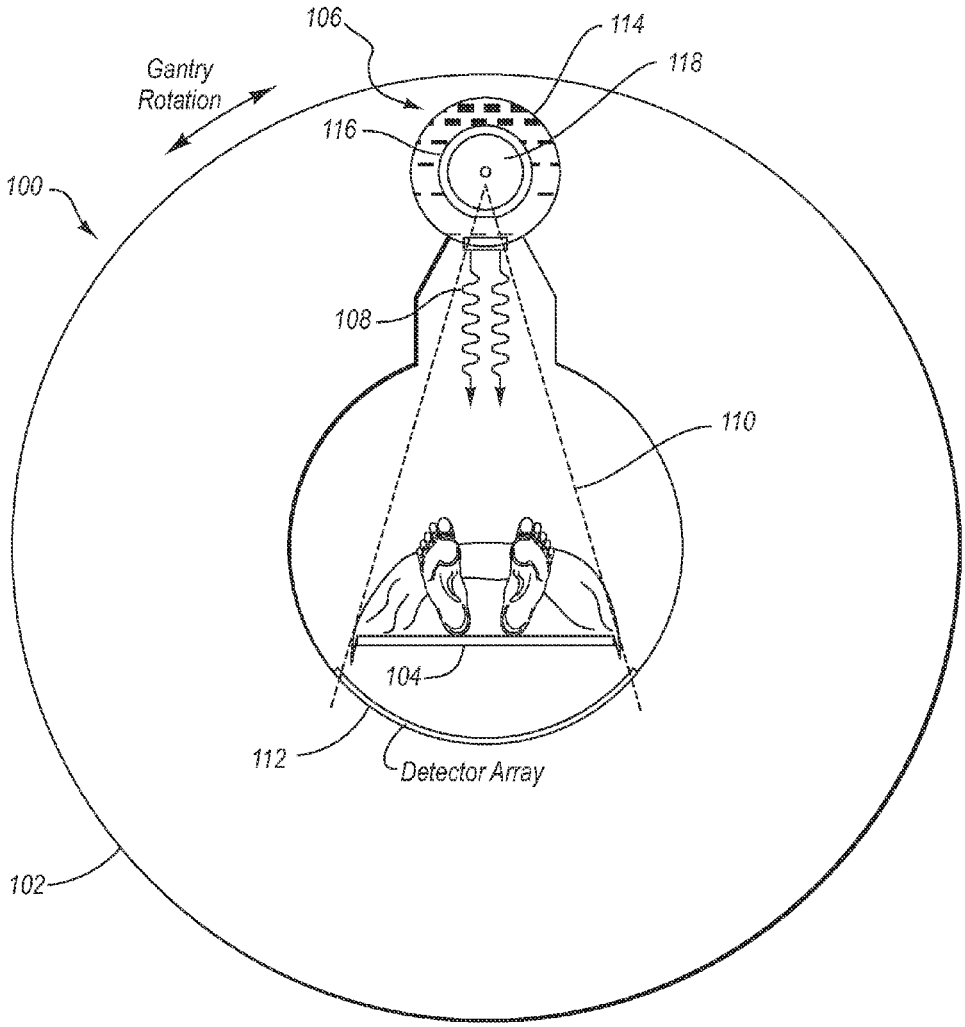
FIG. 1 is a depiction of one environment wherein an x-ray tube including an embodiment of a magnetic assist bearing assembly may be used.
Figure 2A:
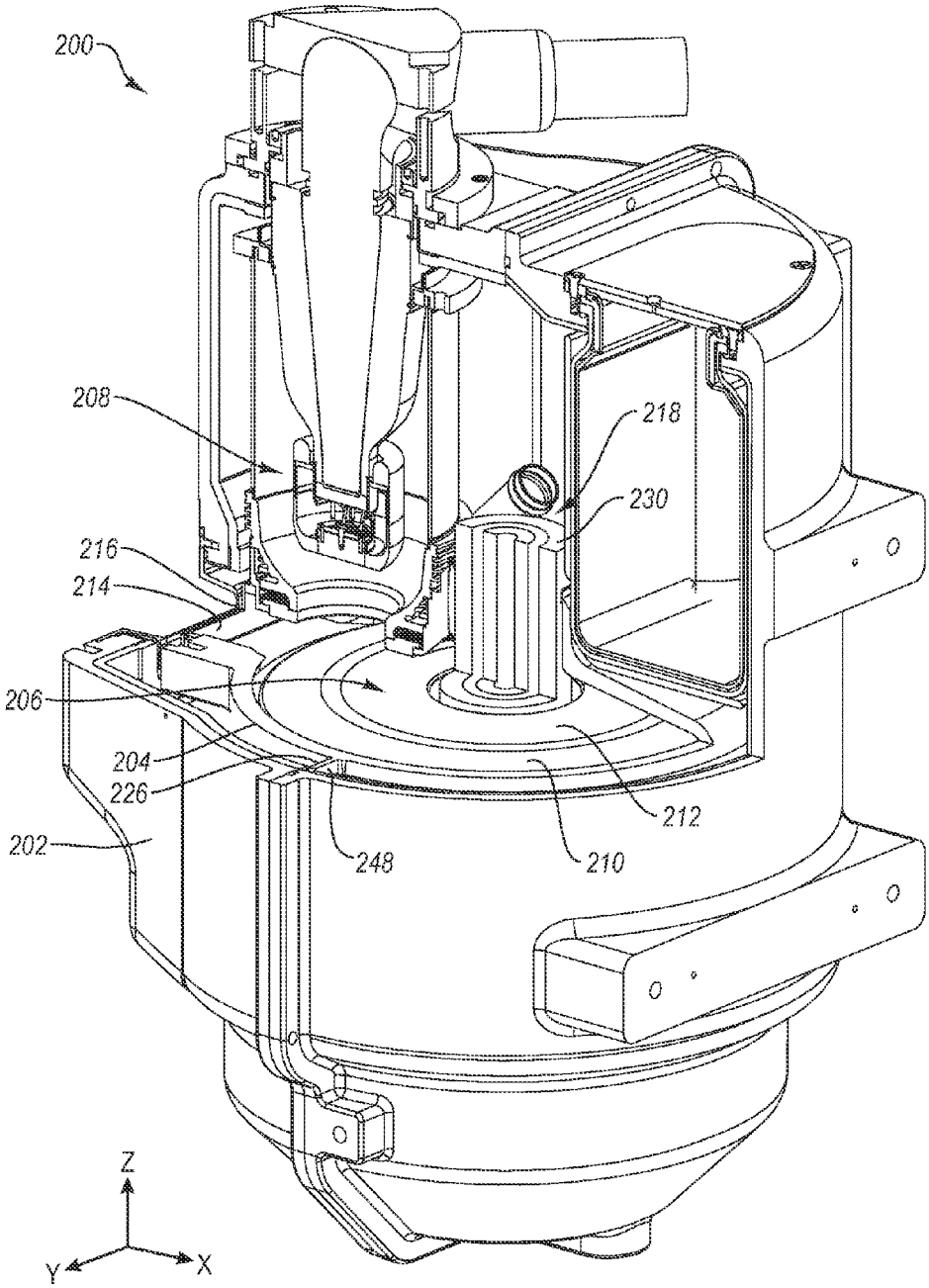
FIG. 2A is a simplified double cross-sectional depiction of an x-ray tube according to an embodiment of the invention including an active magnetic assist bearing assembly.
Figure 2B:
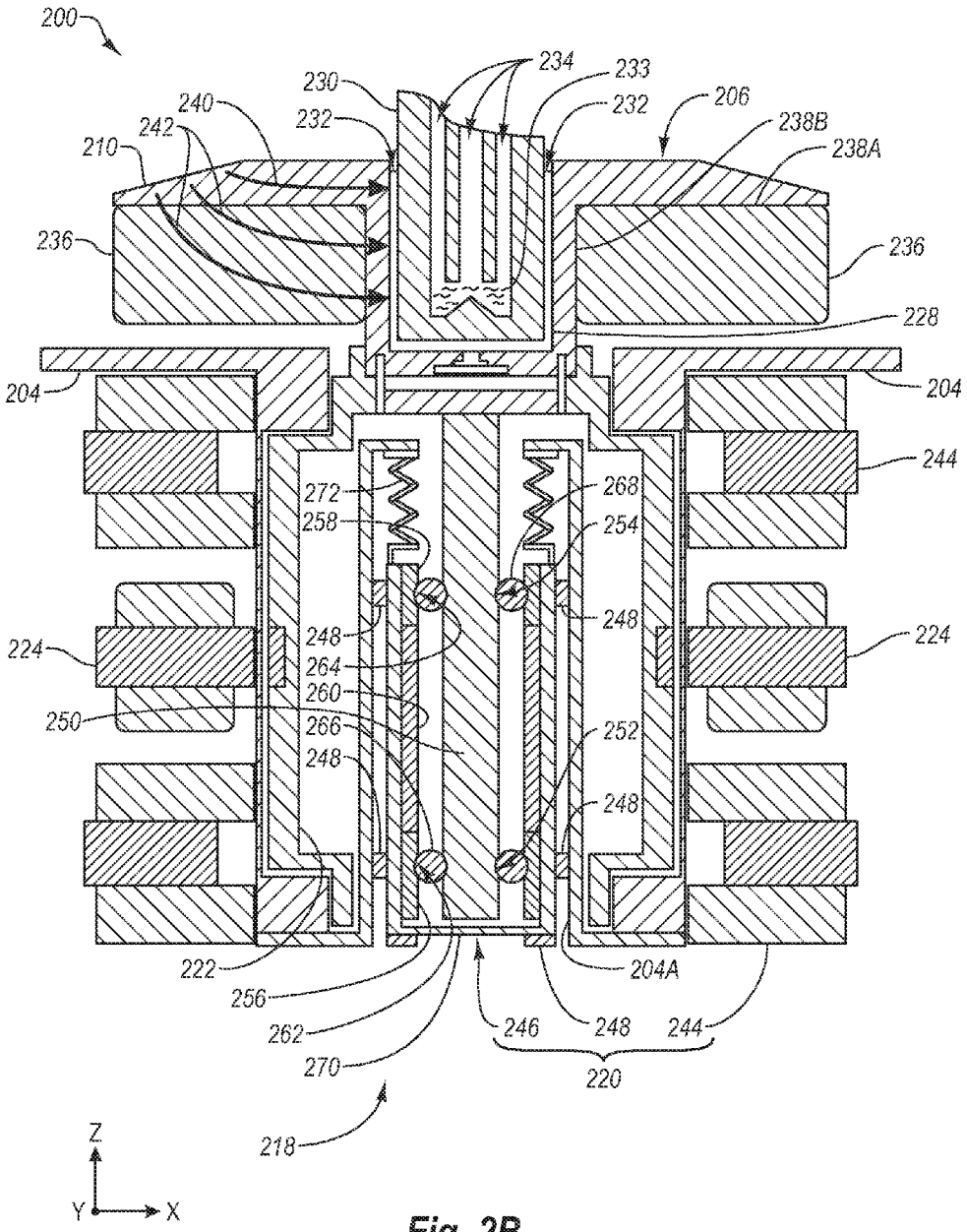
FIG. 2B is a partial cross-sectional view of the x-ray tube of FIG. 2A.

FIGS. 1-2B disclose various aspects of some example embodiments of the invention. Embodiments of the x-ray tube may employ an active or passive magnetic assist bearing ("MAB") assembly to rotatably support one or more rotating components of the x-ray tube. Embodiments of the x-ray tube may, among other things, help reduce noise caused by the rotating components of the x-ray tube by employing one or more magnetic actuators or permanent magnets to shoulder a substantial portion of the load of the rotating components. Alternately or additionally, embodiments of the x-ray tube may be comparatively less expensive than an x-ray tube employing a conventional magnetic bearing assembly by utilizing one or more ball bearing assemblies to shoulder a remaining portion of the load. Note that the principles disclosed herein can also be applied to other x-ray tubes or devices, or any other rotating machinery, where reduced noise is desired without the expense of a conventional magnetic bearing assembly.

I. Example Operating Environment

Reference is first made to FIG. 1, which depicts one operating environment in which an x-ray tube having an active or passive MAB assembly made in accordance with embodiments of the present invention can be utilized. FIG. 1 discloses a CT scanner depicted at 100, which generally comprises a rotatable gantry 102 and a patient platform 104. An x-ray tube 106 is shown mounted to the gantry 102 of the scanner 100. In operation, the gantry 102 rotates about a patient lying on the platform 104. The x-ray tube 106 is selectively energized during this rotation, thereby producing a beam of x-rays 108 that emanate from the x-ray tube 106 substantially as a conically diverging beam, the path of which is generally indicated at 110 in FIG. 1. After passing through the patient, the x-rays 108 are received by a detector array 112. The x-ray information received by the detector array 112 can be manipulated into images of internal portions of the patient's body to be used for medical evaluation and diagnostics.

In FIG. 1, the x-ray tube 106 is shown in cross-section and depicts various components of the x-ray tube 106, including an outer housing 114, an evacuated enclosure 116, and an anode 118 disposed inside the evacuated enclosure 116. Generally, the x-rays 108 in beam path 110 are produced when energized electrons impinge on the anode 118, as will be described in greater detail below.

FIG. 1 discloses one example environment in which an x-ray tube 106 according to embodiments of the invention might be utilized. However, it will be appreciated that there are other environments for which embodiments of the x-ray tube 106 would find use and application.

II. First Example Embodiment

Reference is now made to FIG. 2A, which illustrates an example rotating anode-type x-ray tube, designated generally at 200. The x-ray tube 200 of FIG. 2A may correspond to the x-ray tube 106 of FIG. 1. As shown in FIG. 2A, x-ray tube 200 includes an outer housing 202, within which is disposed an evacuated enclosure 204. A cooling fluid (not shown) can also be disposed within the outer housing 202 and circulated around the evacuated enclosure 204 to assist in x-ray tube 200 cooling and to provide electrical isolation between the evacuated enclosure 204 and the outer housing 202. In some embodiments, the cooling fluid may comprise dielectric oil, which exhibits desirable thermal and electrical insulating properties for some applications, although cooling fluids other than dielectric oil can alternately or additionally be implemented in the x-ray tube 200.

Disposed within the evacuated enclosure 204 are an anode 206 and a cathode 208. The anode 206 is spaced apart from and oppositely disposed to the cathode 208, and may be at least partially composed of a thermally conductive material such as copper or a molybdenum alloy. The anode 206 and cathode 208 are connected in an electrical circuit that allows for the application of a high voltage potential between the anode 206 and the cathode 208. The cathode 208 includes a filament (not shown) that is connected to an appropriate power source and, during operation, an electrical current is passed through the filament to cause electrons to be emitted from the cathode 208 by thermionic emission. The application of a high voltage differential between the anode 206 and the cathode 208 then causes the electrons to accelerate from the cathode filament toward a focal track 210 that is positioned on a target 212 of the anode 206. The focal track 210 is typically composed of tungsten or other material(s) having a high atomic ("high Z") number. As the electrons accelerate, they gain a substantial amount of kinetic energy, and upon striking the target material on the focal track 210, some of this kinetic energy is converted into electromagnetic waves of very high frequency, i.e., x-rays 108, shown in FIG. 1.

Returning to FIG. 2A, the focal track 210 is oriented so that emitted x-rays are directed toward an evacuated enclosure window 214. The evacuated enclosure window 214 is comprised of an x-ray transmissive material that is positioned within a port defined in a wall of the evacuated enclosure 204 at a point aligned with the focal track 210. An outer housing window 216 is disposed so as to be at least partially aligned with the evacuated enclosure window 214. The outer housing window 216 is similarly comprised of an x-ray transmissive material and is disposed in a port defined in a wall of the outer housing 202. The x-rays that emanate from the evacuated enclosure 204 and pass through the outer housing window 216 may do so substantially as a conically diverging beam.

The anode 206 is rotatably supported by an anode support assembly 218, as best seen in FIG. 2B, which illustrates some aspects of the x-ray tube 200 in simplified cross-section. In some embodiments, the anode support assembly 218 generally comprises an active MAB assembly 220 and a rotor sleeve 222. In other embodiments of the invention, the anode support assembly 218 can comprise a passive MAB assembly (FIGS. 5 and 6) and the rotor sleeve 222.

The active MAB assembly 220 is at least partially disposed in the evacuated enclosure 204, and is described in additional detail below. A portion of the active MAB assembly 220 is attached to a portion of the evacuated enclosure 204 such that the anode 206 is rotatably supported by the active MAB assembly 220, thereby enabling the anode 206 to rotate with respect to the evacuated enclosure 204. A stator 224 is disposed about the rotor sleeve 222 and utilizes rotational electromagnetic fields to cause the rotor sleeve 222 to rotate. The rotor sleeve 222 is attached to the anode 206, thereby providing the needed rotation of the anode 206 during x-ray tube 200 operation.

Returning to FIG. 2A, the evacuated enclosure 204 can be fixedly secured to the outer housing 202 via a plurality of flanges 226 formed with the evacuated enclosure 204. In some embodiments, one or more sensors can be positioned between the evacuated enclosure 204 and outer housing 202 to detect a load exerted on the active MAB assembly 220 by the anode 206. For instance, the one or more sensors can be disposed on the flange 226 between the outer housing 202 and evacuated enclosure 204, such as is denoted at 248 in FIG. 2A. In this example, the load exerted on the active MAB assembly 220 can be detected indirectly, e.g. by detecting the load transferred from the active MAB assembly 220 to the evacuated enclosure 204. As will be explained in more detail below, the active MAB assembly 220 may then employ load detection to rotatably support the anode 206.

A. Active Cooling

Although not required, some embodiments of the x-ray tube 200 can include an active cooling system at least partially disposed within the evacuated enclosure 204 for transferring heat away from the anode 206. To this end, in some example embodiments, the anode 206 defines a cavity 228 extending from the top of the anode 206 towards the bottom of the anode 206, as shown in FIG. 2B. The cavity 228 may be substantially cylindrical in shape and can be substantially centered about a geometric axis of rotation of the anode 206.

The active cooling system can include a cooling shaft 230 extending into the cavity 228 defined by the anode 206. The portion of the cooling shaft 230 extending into the cavity 228 may be smaller than the cavity 228 and can be complementary in shape to allow the anode 206 to rotate with respect to the cooling shaft 230 during operation.

A liquid metal interface 232 can be provided in the space between cooling shaft 230 and the walls of cavity 228 to facilitate heat transfer from the anode 206 to the cooling shaft 230, the liquid metal interface 232 thermally coupling the active cooling system to the anode 206. Generally, the liquid metal interface 232 comprises a metal material existing in liquid form over a temperature range that includes the range of operating temperatures of the anode 206. In some embodiments, the liquid metal interface 232 comprises one or more of gallium, indium, or tin, or the like or any combination thereof, including gallium eutectic, for example.

Alternately or additionally, the cooling shaft 230 can include one or more channels 234 formed in the cooling shaft 230. The active cooling system may further include a cooling fluid (denoted at 233 in FIG. 2B) that is circulated through the channels 234 by a pump (not shown), for instance, to carry heat away from the anode 206 to a heat sink (not shown).

A substrate 236 can be coupled to the anode 206 to further facilitate heat transfer from the anode 206 to the cooling shaft 230. In particular, in the embodiment of FIG. 2B, the substrate 236 can be coupled to the anode 206 at first interface 238A and second interface 238B. The substrate 236 can be coupled to the anode 206 at first and second interfaces 238A, 238B via welding or brazing, for instance. Alternately or additionally, the substrate 236 can comprise graphite.

The substrate 236 can increase the heat conduction paths available from the focal track 210 to the cooling shaft 230, effectively increasing the heat transfer ability of the anode 206. For instance, heat can be transferred from the focal track 210 to the cooling shaft 230 via heat conduction path 240. Alternately or additionally, heat can be transferred from the focal track 210 to the cooling shaft 230 via additional heat conduction paths 242. By providing greater heat conduction to the actively cooled system via additional heat conduction paths 242, the anode 206 can be operated a relatively longer period of time without overheating than a comparable anode that lacks additional heat conduction paths 242.

Alternately or additionally, the substrate 236 can be coupled to the anode 206 at only one of first or second interface 238A or 238B. For instance, the substrate 236 can be coupled to the anode 206 at first interface 238A, with a spatial separation from the anode 206 at second interface 238B. In this case, the substrate 236 can generally receive, store and radiatively dissipate heat from the focal track 210, without providing the additional heat conduction paths 242.

FIG. 2A discloses one example environment in which an active cooling system and/or an active MAB assembly 220 and/or a passive MAB assembly according to embodiments of the invention might be utilized. However, it will be appreciated that there are many other x-ray tube configurations and environments for which embodiments of the active cooling system, active MAB assembly 220, and/or a passive MAB assembly would find use and application.

B. Active Magnetic Assist Bearing Assembly

The active MAB assembly 220 rotatably supports the anode 206 and other rotating components coupled to the anode 206, such as the substrate 236, the rotor sleeve 222, and the like. For simplicity in this disclosure, the active MAB assembly 220 will be discussed as rotatably supporting the anode 206, with the understanding that the active MAB assembly 220 also rotatably supports the other rotating components coupled to the anode 206.

Rotatably supporting the anode 206 can include shouldering a load exerted on the active MAB assembly 220 by the anode 206 to maintain the anode 206 in a predetermined position within the x-ray tube 200 while allowing the anode 206 to rotate within the x-ray tube 200. The load exerted on the active MAB assembly 220 by the anode 206 can comprise one or more axial, radial, and/or torque loads, as will be explained in greater detail below.

Figure 3:
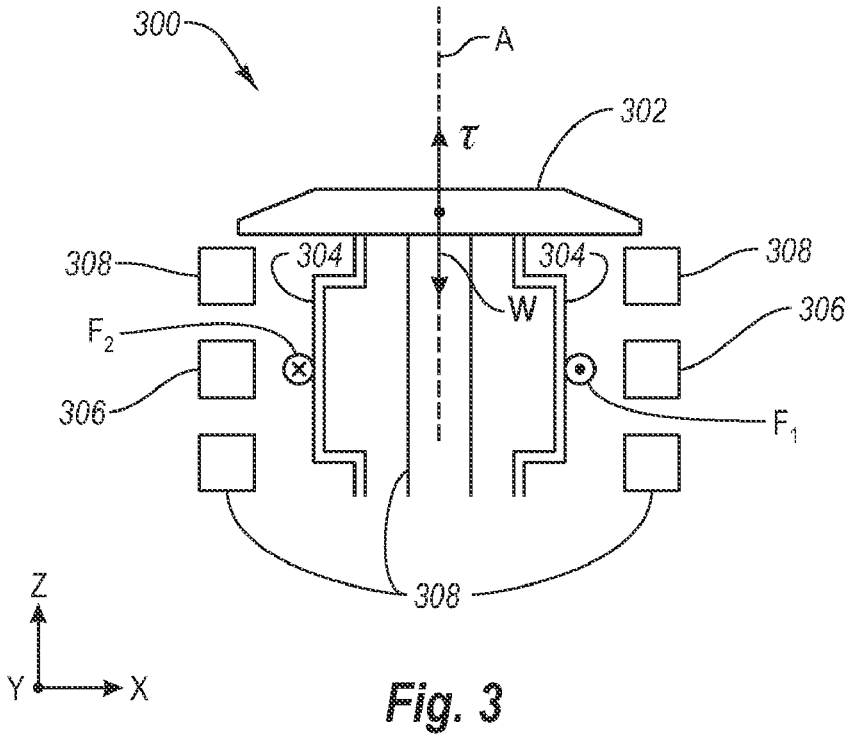
FIG. 3 is a partial cross-sectional depiction of a stationary x-ray tube and various loads that can be exerted on a rotating anode of the x-ray tube.
Figure 4B:
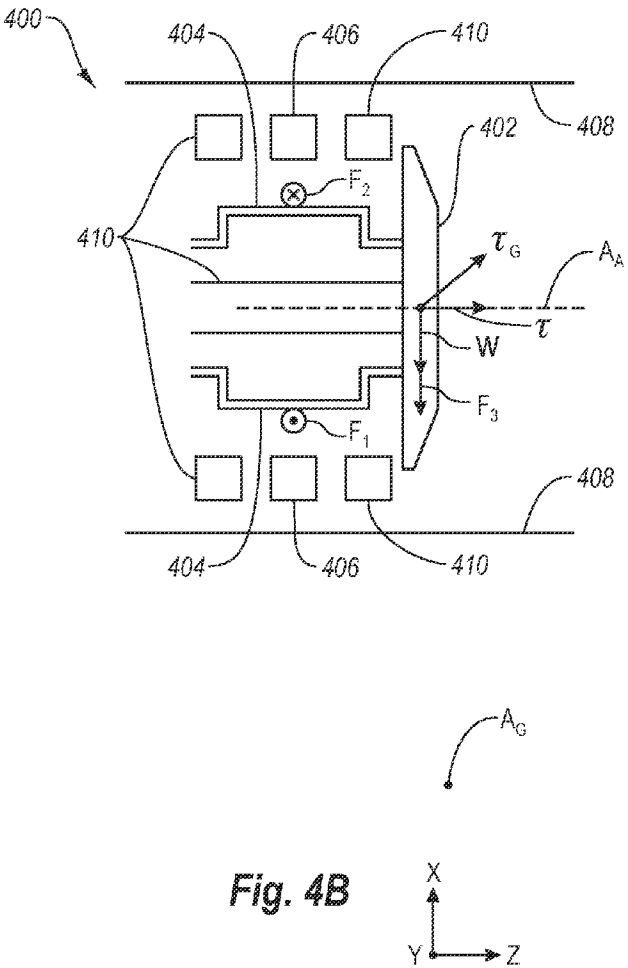
FIGS. 4A and 4B are partial cross-sectional views of an x-ray tube mounted to a rotatable gantry in two different configurations and various loads that can be exerted on a rotating anode of the x-ray tube.

Turning to FIGS. 3-4B, three simplified diagrams are provided to better understand some of the loads that can act on a rotating anode under various operating conditions. The anodes depicted in FIGS. 3-4B may correspond, for example, to the anode 206 of FIGS. 2A and 2B. FIG. 3 depicts a simplified cross-sectional side view of an x-ray tube 300 comprising an anode 302, a rotor sleeve 304 and a stator 306. In the example of FIG. 3, the x-ray tube 300 can comprise a stationary x-ray tube oriented such that the weight of the anode 302, represented by the force W, is substantially parallel to an axis of rotation A of the anode 302. In other stationary x-ray tube orientations, however, the weight W of the anode 302 may be at some other angle relative to the axis of rotation A.

The stator 306 is disposed about the rotor sleeve 304 and utilizes rotational electromagnetic fields to cause the rotor sleeve 304 to rotate. More particularly, the stator 306 utilizes rotational electromagnetic fields to exert forces on the rotor sleeve 304 having tangential components $F_1$ and $F_2$. Because the rotor sleeve 304 is coupled to the anode 302, the tangential force components $F_1$ and $F_2$ create a torque r on the anode 302. The torque $\tau$ causes the anode 302 and rotor sleeve 304 to rotate about the axis of rotation A.

An active MAB assembly 308 can be included in the x-ray tube 300 and can be coupled to the anode 302 so as to rotatably support the anode 302. As such, the weight W of the anode 302 can be exerted by the anode 302 axially, e.g. along the axis A, upon the active MAB assembly 308. Accordingly, the weight W of the anode 302 is one example of an axial load that can be exerted by the anode 302 on an active MAB assembly 308 rotatably supporting the anode 302 in the x-ray tube 300 during stationary operation of the x-ray tube 300.

Figure 4A:
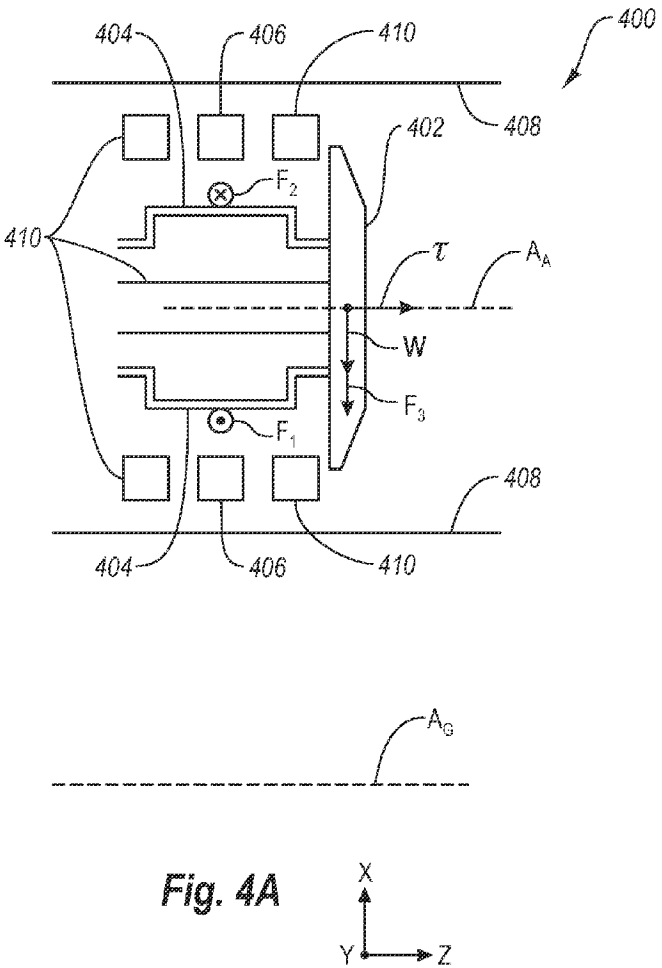

FIG. 4A depicts a simplified cross-sectional side view of an x-ray tube 400 comprising an anode 402, a rotor sleeve 404, a stator 406, an evacuated enclosure 408 and an active MAB assembly 410. Although the stator 406 and active MAB assembly 410 are illustrated in FIGS. 4A (and 4B) as being disposed inside the evacuated enclosure 408, in other embodiments, some or all of the stator 406 and MAB assembly 410 are disposed outside the evacuated enclosure 408. Alternately or additionally, evacuated enclosure 408 can comprise a non-magnetic material.

In the example of FIG. 4A, the x-ray tube 400 can be mounted on a rotatable gantry (not shown), such as the rotatable gantry 102 of FIG. 1. The x-ray tube 400 rotates around a gantry axis $A_G$, while the anode 402 rotates within the x-ray tube 400 around an anode axis $A_A$ that is substantially parallel to the gantry axis $A_G$.

The weight W of the anode 402 is always directed downwards. However, as the x-ray tube 400 rotates about the gantry axis $A_G$, the direction of the weight W continuously changes relative to a fixed reference frame of the evacuated enclosure 408, denoted by reference axes x, y and z. For instance, when the x-ray tube 400 is immediately above a patient at the top of the rotatable gantry as shown in FIG. 4A, the direction of the weight W may be substantially parallel to the direction of x-ray emission and substantially normal to the y-z plane. In contrast, when the x-ray tube 400 is immediately to the left or right of a patient, the direction of the weight W of anode 402 may be substantially normal to the direction of x-ray emission and substantially normal to the x-z plane.

The active MAB assembly 410 can be coupled to the anode 402 and the evacuated enclosure 408 so as to rotatably support the anode 402. As such, the weight W of the anode 402 can be exerted by the anode 402 upon the active MAB assembly 410 in a radial direction, e.g. normal to the anode axis $A_A$, that varies as the x-ray tube 400 rotates about the gantry axis $A_G$. Accordingly, in the example of FIG. 4A, the weight W of anode 402 is one example of a radial load that can be exerted by the anode 402 on an active MAB assembly 410 rotatably supporting the anode 402 in the x-ray tube 400 during rotatable operation of the x-ray tube 400.

In FIG. 4A, the stator 406 utilizes rotational electromagnetic fields to exert forces on the rotor sleeve 404 having tangential force components $F_1$ and $F_2$, the tangential force components $F_1$ and $F_2$ creating a torque $\tau$ on the anode 402, and the torque $\tau$ causing the anode 402 and rotor sleeve 404 to rotate about the anode axis $A_A$.

Furthermore, a portion of the active MAB assembly 410 can be fixedly secured to the evacuated enclosure 408. The rotatable gantry exerts a force $F_3$ on the x-ray tube 400 during rotation, which is also exerted on the anode 402 and rotor sleeve 404 via the evacuated enclosure 408 and active MAB assembly 410. The force $F_3$ generally includes at least a radial component directed towards the gantry axis $A_G$, the radial component of force $F_3$ causing the x-ray tube 400 and anode 402 to rotate about the gantry axis $A_G$. Alternately or additionally, the force $F_3$ can include an axial component as a result of moving the rotatable gantry, including the x-ray tube 400, axially along the gantry axis $A_G$ during operation.

In this example, the rotatable gantry has to exert the force $F_3$ on the anode 402 via evacuated enclosure 408 and active MAB assembly 410 to rotate the anode 402 about the gantry axis $A_G$. In turn, the anode 402 generates a reactive force (not shown) that loads the active MAB assembly 410. The reactive force of the force $F_3$ can be in the opposite direction as the force $F_3$ and can include a radial and/or axial component. Accordingly, in the example of FIG. 4A, the reactive force of the force $F_3$ is one example of a radial and/or axial load that can be exerted by the anode 402 on the active MAB assembly 410.

Turning next to FIG. 4B, the x-ray tube 400 is disclosed in a different orientation relative to a rotatable gantry than in FIG. 4A. In particular, in the example of FIG. 4B, the x-ray tube 400 can be mounted on a rotatable gantry (not shown) configured to rotate around a gantry axis $A_G$ that is substantially normal to and spaced apart from the anode axis $A_A$.

In FIG. 4B, the loads acting on the anode 402 include the downward-directed weight W of the anode 402, the torque $\tau$ which causes the anode 402 to rotate about the anode axis $A_A$, and the force $F_3$. The weight W of the anode 402 is always directed downwards. However, as the x-ray tube 400 rotates about the gantry axis $A_G$, the direction of the weight W continuously changes relative to the fixed reference frame 412 of the evacuated enclosure 408. For instance, when the x-ray tube 400 is immediately above a patient at the top of the rotatable gantry as shown in FIG. 4B, the direction of the weight W may be substantially parallel to the direction of x-ray emission and substantially normal to the y-z plane. In contrast, when the x-ray tube 400 is immediately to the left or right of a patient, the direction of the weight W of anode 402 may be substantially normal to the direction of x-ray emission and substantially normal to the x-y plane.

In this example, the weight W of the anode 402 can be exerted by the anode 402 upon the active MAB assembly 410 in a direction that includes a radial component and/or an axial component relative to the anode axis $A_A$. Accordingly, in the example of FIG. 4B, the weight W of anode 402 is one example of a radial and/or axial load that can be exerted by the anode 402 on the active MAB assembly 410.

Alternately or additionally, the anode 402 can generate a reactive force (not shown) to the force $F_3$ that is in the opposite direction as the force $F_3$. The reactive force to the force $F_3$ can include a radial and/or an axial component. Accordingly, in the example of FIG. 4B, the reactive force to the force $F_3$ is another example of a radial and/or axial load that can be exerted by the anode 402 on the active MAB assembly 410.

Alternately or additionally, in this and other examples, the rotatable gantry can exert a gyroscopic torque $\tau_G$ on the anode 402 via the evacuated enclosure 408 and active MAB assembly 410. More particularly, during operation, the anode 402 rotates around the anode axis $A_A$ and the x-ray tube 400 simultaneously rotates around the gantry axis $A_G$. The rotation of the x-ray tube 400 about the gantry axis $A_G$ causes the direction of the anode axis $A_A$ of anode 402 to change relative to the gantry axis $A_G$. Such a change in direction of the axis of a rotating object such as the anode 402 is referred to as gyroscopic precession.

In this example, the anode 402 wants to remain rotating about a fixed axis of rotation $A_A$ and the rotatable gantry has to exert the gyroscopic torque $\tau_G$ on the anode 402 via the evacuated enclosure 408 and an active MAB assembly 410 to induce the gyroscopic precession. In turn, the anode 402 resists the induction of gyroscopic precession, generating a reactive torque (not shown) that loads the active MAB assembly 410. The reactive torque to the gyroscopic torque $\tau_G$ can be in the opposite direction as the gyroscopic torque $\tau_G$. Accordingly, in the example of FIG. 4B, the reactive torque to the gyroscopic torque $\tau_G$ is one example of a torque that can be exerted by the anode 402 on the active MAB assembly 410.

In summary, the loads exerted by an anode on an active MAB assembly can include axial, radial, and/or torque loads, such as described above with respect to FIGS. 3-4B. Alternately or additionally, the loads exerted by an anode on an active MAB assembly can include other loads not specifically described herein. Further, use of the generic term "load" or "loads" herein can refer to one or more of the axial, radial, and/or torque loads described with respect to FIGS. 3-4B as well as other loads not specifically described herein.

Returning to FIG. 2B, and as mentioned above, the active MAB assembly 220 can rotatably support the anode 206 by shouldering one or more of the loads exerted on the active MAB assembly 220 by the anode 206 to maintain the anode 206 in a predetermined position within the x-ray tube 200 while allowing the anode 206 to rotate within the x-ray tube 200. As used herein, the active MAB assembly 220 "shoulders" a load exerted on the active MAB assembly 220 by the anode 206 by exerting a counteracting force or torque on the anode 206 so as to suspend the anode 206 at a predetermined position within the x-ray tube 200.

For example, the loads exerted on the active MAB assembly 220 by the anode 206 can include axial loads such as the weight W of the anode 302 in the stationary x-ray tube 300 of FIG. 3. In this example, the active MAB assembly 220 can shoulder the weight of the anode 206 by exerting a counteracting axial force on the anode 206 that is opposite in direction to the weight of the anode 206.

As another example, the loads exerted on the active MAB assembly 220 by the anode 206 can include radial loads such as the weight W of the anode 402 in the x-ray tube 400 of FIG. 4A. In this example, the active MAB assembly 220 can shoulder the weight of the anode 206 by exerting a counteracting radial force on the anode 206 that is opposite in direction to the weight of the anode 206.

As another example, the loads exerted on the active MAB assembly 220 by the anode 206 can include loads having radial and/or axial components depending on the position of the x-ray tube 200 in a corresponding rotatable gantry, such as the reactive force to the force $F_3$ in the examples of FIGS. 4A and 4B. In this example, the active MAB assembly 220 can shoulder the reactive force by exerting the force $F_3$ on the anode 206 to begin with, the force $F_3$ being opposite in direction to the reactive force.

As yet another example, the loads exerted on the active MAB assembly 220 by the anode 206 can include torque loads, such as the reactive torque to the torque $\tau_G$ in the example of FIG. 4B. In this example, the active MAB assembly 220 can shoulder the reactive torque by exerting the torque $\tau_G$ on the anode 206 to begin with, the torque $\tau_G$ being opposite in direction to the reactive torque.

As shown in FIG. 2B, the active MAB assembly 220 includes one or more magnetic actuators 244, a ball bearing assembly 246, and means for detecting 248. The magnetic actuators 244 can shoulder a portion of the load exerted by the anode 206 on the active MAB assembly 220 during rotation of the anode 206. The ball bearing assembly 246 can stabilize the anode 206, shouldering a portion of the load exerted by the anode 206 on the active MAB assembly 220 that is not shouldered by the magnetic actuators 244. The means for detecting 248 can detect the loads exerted on the active MAB assembly 220 by the anode 206 and use the load information to control the magnetic actuators 244.

In some embodiments, each of the magnetic actuators 244 and ball bearing assembly 246 shoulder a substantial portion of the load. As used herein, a portion of the load is "substantial" if it is significant enough to allow the other component to be implemented in a form that is less robust than would be required to individually shoulder the load. For instance, the magnetic actuators 244 shoulder a substantial portion of the load if the portion is significant enough to allow the ball bearing assembly 246 to be implemented in a form that is less robust than would be required for the ball bearing assembly 246 to individually shoulder the load without being aided by the magnetic actuators 244. Similarly, the ball bearing assembly 246 shoulders a substantial portion of the load if the portion is significant enough to allow the magnetic actuators 244 and associated circuitry to be implemented in a form that is less robust than would be required for the magnetic actuators 244 and associated circuitry to individually shoulder the load without being aided by the ball bearing assembly 246.

Alternately or additionally, in some embodiments, the magnetic actuators 244 shoulder most, e.g. more than half, of the load exerted by the anode 206 on the active MAB assembly 220 during rotation of the anode 206. In other embodiments, the ball bearing assembly 246 shoulders most of the load exerted by the anode 206 on the active MAB assembly 220 during rotation of the anode 206. In yet other embodiments, the portions of the load shouldered by the magnetic actuators 244 and ball bearing assembly 246 are substantially equal. Accordingly, embodiments of the invention cover a wide range of load shouldering responsibilities between the magnetic actuators 244 and the ball bearing assembly 246.

Because the magnetic actuators 244 shoulder a portion of the load exerted on the active MAB assembly 220 by the anode 206, the ball bearing assembly 246 can be relatively smaller and quieter than a ball bearing assembly configured to support equivalent loads without the aid of magnetic actuators. Additionally, use of the ball bearing assembly 246 to stabilize the anode 206 allows the means for detecting 248 and other feedback circuits and components employed to control the magnetic actuators 244 to be much simpler and less expensive than the feedback circuits and components employed in conventional magnetic bearing assemblies.

In more detail, the magnetic actuators 244 can be circumferentially disposed about the rotor sleeve 222. Although depicted as being separate from the stator 224, in some embodiments the magnetic actuators 244 can be included as part of the stator 224. In operation, the magnetic actuators 244 can shoulder a portion of the load exerted by the anode 206 on the active MAB assembly 220 by utilizing electromagnetic fields that create forces that act on the anode 206, either directly or indirectly via the rotor sleeve 222, to counteract a portion of the load. For instance, when the weight of the anode 206 is axially loading the active MAB assembly 220 in the negative z-direction, such as in the example of FIG. 3, the magnetic actuators 244 can create a force in the positive z-direction that is exerted on the anode 206 and/or the rotor sleeve 222 to counteract a portion of the weight of the anode 206.

As another example, when the weight of the anode 206 is radially loading the active MAB assembly 220 in a varying x- and/or y-direction, such as in the example of FIG. 4A, the magnetic actuators 244 can create a directionally varying force in the x- and/or y-direction that is exerted on the anode 206 and/or the rotor sleeve 222 to counteract a portion of the weight of the anode 206.

As another example, with combined reference to FIGS. 2B and 4A or 2B and 4B, the magnetic actuators 244 can exert a portion of the force $F_3$ on the anode 206, the force $F_3$ causing the anode 206 to rotate about gantry axis $A_G$ and/or to move axially along the gantry axis $A_G$. Alternately or additionally, with combined reference to FIGS. 2B and 4B, the magnetic actuators 244 can exert a portion of the torque $\tau_G$ on the anode 206, the torque $\tau_G$ inducing gyroscopic precession of the anode 206 as it rotates about the gantry axis $A_G$.

In some embodiments, the magnetic actuators 244, combined with the rotor sleeve 222, reduce the portion of the load exerted directly on the ball bearing assembly 246 by shouldering a portion of the load exerted by the anode 206 on the active MAB assembly 220. In particular, because the magnetic actuators 244 shoulder a portion of the load exerted by the anode 206 on the active MAB assembly 220, less than all of the load exerted by the anode 206 on the active MAB assembly 220 is shouldered by the ball bearing assembly 246. Accordingly, the ball bearing assembly 246, which can be coupled directly to the anode 206 and/or rotor sleeve 222, stabilizes the anode 206 and/or other rotating components during rotation of the anode 206 and/or other rotating components, such that the magnetic actuators 244 do not have to rigorously levitate the anode 206 and/or other rotating components to a precise tolerance. As used herein, "stabilizing the anode 206" can include shouldering less than all of the load and/or reacting quickly to small load changes exerted by the anode 206 on the active MAB assembly 220 to maintain the anode 206 at a predetermined position, within tight tolerances, within the x-ray tube 200.

As shown in FIG. 2B, the ball bearing assembly 246 includes a shaft 250, which may comprise high-temperature tool steel, tungsten tool steel, molybdenum tool steel, ceramic, or other suitable material(s). The shaft 250 can be coupled to the anode 206 and/or rotor sleeve 222, the rotor sleeve 222 being circumferentially disposed about the ball bearing assembly 246. The shaft 250 defines a lower inner race 252 and upper inner race 254 disposed circumferentially about shaft 250. Lower and upper inner races 252 and 254 include bearing surfaces that may be coated with a solid metal lubricant or other suitable material.

Ball bearing assembly 246 additionally includes lower bearing ring 256 and upper bearing ring 258 disposed about shaft 250 and separated by a spacer 260. While other spacer arrangements could be used, in the illustrated example a tubular-shaped spacer 260 is used. Alternately or additionally, an "O"-shaped spacer and/or "C"-shaped spacer can be used alone or in combination with the spacer 260. Lower bearing ring 256 defines lower outer race 262 and upper bearing ring 258 defines upper outer race 264. Each of the lower outer race 262 and upper outer race 264 include respective bearing surfaces that may be coated with a solid metal lubricant or other suitable lubricant.

As in the case of shaft 250, lower and upper bearing rings 256 and 258 and spacer 260 may comprise high temperature tool steel, tungsten tool steel, molybdenum tool steel, ceramic, or other suitable material(s). However, it will be appreciated that various other materials may be employed for the shaft 250, lower and upper bearing rings 256 and 258, and/or spacer 260 consistent with a desired application.

With more specific reference now to lower and upper bearing rings 256 and 258, and spacer 260, additional details are provided regarding the arrangement of such components with respect to shaft 250. In particular, lower bearing ring 256, upper bearing ring 258, and spacer 260, are disposed about shaft 250 so that lower outer race 262 and upper outer race 264 are substantially aligned with, respectively, lower inner race 252 and upper inner race 254 defined by shaft 250. In this way, lower outer race 262 and upper outer race 264 cooperate with, respectively, lower inner race 252 and upper inner race 254 to define a lower race 252/262 and an upper race 254/264 that confine a lower ball set 266 and an upper ball set 268, respectively. Both lower ball set 266 and upper ball set 268 comprise respective pluralities of balls. In general, lower ball set 266 and upper ball set 268 cooperate to facilitate high-speed rotary motion of shaft 250, and thus of anode 206.

It will be appreciated that variables such as the number and diameter of balls in each of the lower ball set 266 and upper ball set 268 may be varied as required to suit a particular application. Further, in some embodiments of the invention, each of the balls in lower ball set 266 and upper ball set 268 are coated with a solid metal lubricant or other suitable material.

The ball bearing assembly 246 is one example of a ball bearing assembly that can be employed in a active MAB assembly 220. In other embodiments, however, the active MAB assembly 220 can employ a ball bearing assembly comprising a single bearing ring cooperating with the shaft to define a single race, and a single ball set disposed in the single race. Alternately or additionally, the active MAB assembly 220 can employ a ball bearing assembly that includes more than two races defined by more than two bearing rings and a shaft, and more than two ball sets. Alternately or additionally, the active MAB assembly 220 can employ two or more ball bearing assemblies.

Directing continuing attention to FIG. 2B, the ball bearing assembly 246 includes bearing housing 270 which serves to receive and securely retain lower and upper bearing rings 256 and 258, lower and upper ball sets 266 and 268, as well as at least a portion of shaft 250. In some embodiments, the bearing housing 270 defines an interior cavity substantially in the shape of a seamless cylinder and comprises a durable, high-strength metal or metal alloy, such as stainless steel or the like, that is suitable for use in high temperature x-ray tube operating environments.

The bearing housing 270 can be coupled, either directly or indirectly, to the evacuated enclosure 204 and cooperates with the evacuated enclosure 204 to provide vacuum containment, maintaining the anode 206, cathode 208 (FIG. 2A), rotor sleeve 222, shaft 250, lower and upper bearing rings 256 and 258, lower and upper ball sets 266 and 268, and spacer 260 in a substantial vacuum. In the example of FIG. 2B, the bearing housing 270 is indirectly coupled to the evacuated enclosure 204 via a flexible bellows 272 that is coupled between the bearing housing 270 and the evacuated enclosure 204. The flexible bellows 272 cooperates with the bearing housing 270 and evacuated enclosure 204 to provide vacuum containment, maintaining the anode 206, cathode 208, rotor sleeve 222, shaft 250, lower and upper bearing rings 256 and 258, lower and upper ball sets 266 and 268, and spacer 260 in a substantial vacuum.

The flexible bellows 272 can comprise a resilient material and can allow the load exerted by the anode 206 on the active MAB assembly 220 to be transferred through the ball bearing assembly 246 to the means for detecting 248. For example, in some embodiments, one or more of the means for detecting 248 is coupled between bearing housing 270 and a portion 204A of the evacuated enclosure 204. Alternately or additionally, the one or more means for detecting 248 can be coupled between the bearing housing 270 and one or more other components that are stationary relative to the ball bearing assembly 246.

In this example, rather than rigidly securing the bearing housing 270 to the evacuated enclosure 204, the bearing housing 270 can be movably secured to the evacuated enclosure 204 via the flexible bellows 272. Because the flexible bellows 272 can comprise a resilient material, coupling the bearing housing 270 to the evacuated enclosure 204 via the flexible bellows 272 can permit the ball bearing assembly 246 to be displaced with respect to the evacuated enclosure 204 in response to the anode 206 loading the active MAB assembly 220 through the ball bearing assembly 246. The amount of displacement of the ball bearing assembly 246 with respect to the evacuated enclosure 204 can depend on the resilience, i.e., the spring constant, of flexible bellows 272.

Accordingly, by employing flexible bellows 272 to couple the bearing housing 270 to the evacuated enclosure 204 and by disposing the one or more means for detecting 248 between the bearing housing 270 and evacuated enclosure 204 or other stationary component, the ball bearing assembly 246 can apply mechanical stress to one or more of the means for detecting 248 in response to the anode 206 loading the active MAB assembly 220 through the ball bearing assembly 246. In turn, the means for detecting 248 can thereby detect the load and control the magnetic actuators 244 to shoulder a portion of the load.

In some embodiments, each of the means for detecting 248 can comprise a force sensor, examples of which include piezoelectric transducers such as crystal and ceramic piezoelectric transducers. Piezoelectric transducers generate a signal in response to applied mechanical stress, e.g. force per unit area. In some embodiments, the magnitude of the generated signal is proportional to the applied mechanical stress. In the embodiment of FIG. 2B, when the ball bearing assembly 246 applies a mechanical stress to one or more of the means for detecting 248 in response to a load exerted on the active MAB assembly 220, each of the one or more means for detecting 248 generates a signal indicative of the mechanical stress on the corresponding means for detecting 248.

The signals generated by all of the means for detecting 248 may be collectively indicative of the load on the active MAB assembly 220. After the load on the active MAB assembly 220 has been detected by means for detecting 248, the magnetic actuators 244, in response to one or more command signals or feedback signals from the means for detecting 248, can utilize electromagnetic fields to exert forces and/or torques on the anode 206 and/or rotor sleeve 222 to shoulder a first portion of the detected load while the ball bearing assembly 246 shoulders a remaining portion of the detected load. The magnetic actuators 244 and ball bearing assembly 246 can thereby collectively shoulder all of the load exerted by the anode 206 on the active MAB assembly 220 to maintain the anode 206 substantially at a predetermined position within the x-ray tube 200 and allow the anode 206 to rotate.

According to some embodiments of the invention, the magnetic actuators 244 essentially provide the brute force to maintain the anode 206 within the general area of the predetermined position within the x-ray tube 200. At the same time, by virtue of being directly coupled to the anode 206 and by not employing feedback electronics such as means for detecting 248 and/or feedback circuits, the ball bearing assembly 246 can stabilize the anode 206, which can include reacting quickly to small load changes exerted by the anode 206 on the active MAB assembly 220 to maintain the anode 206 at the predetermined position, within tight tolerances, within the x-ray tube 200.

Because the ball bearing assembly 246 provides stabilization within tight tolerances, the sensors, e.g., the means for detecting 248, and other electronics for sensing changes and supplying forces to the anode 206 do not have to operate at the same high-performance level as sensors and other electronics employed in conventional magnetic bearing assemblies. Thus, in some embodiments, the sensors and other electronics for sensing changes and supplying forces to the anode 206 can be relatively simpler and less expensive than those used in conventional magnetic bearing assemblies.

Moreover, in some embodiments of the invention, the ball bearing assembly 246 is configured to generate relatively less noise than a ball bearing assembly that can, by itself, shoulder a load equivalent to that shouldered by the active MAB assembly 220. The noise generated by a ball bearing assembly while supporting a rotating component(s) can depend on a number of factors, including, among other things, the number of balls in each ball set, the diameter of the balls, and the diameter of the races. Generally speaking, more balls, larger ball diameters, and larger race diameters tend to make a ball bearing assembly noisier than fewer balls, smaller ball diameters, and smaller race diameters.

At the same time, more balls, larger ball diameters, and larger race diameters tend to make a ball bearing assembly more robust and capable of shouldering relatively larger loads than fewer balls, smaller ball diameters, and smaller race diameters. Accordingly, while relatively larger ball bearing assemblies can typically shoulder larger loads than relatively smaller ball bearing assemblies, the relatively larger ball bearing assemblies can also be noisier than the relatively smaller ball bearing assemblies.

As mentioned above, however, the magnetic actuators 244 can shoulder a portion of the load exerted on the active MAB assembly 220 by the anode 206, while the ball bearing assembly 246 can shoulder a remaining portion of the load and/or can stabilize the anode 206. Due to the fact that a portion of the load exerted by the anode 206 on the active MAB assembly 220 is shouldered by the magnetic actuators 244, rather than the ball bearing assembly 246, the ball bearing assembly 246 can be less robust—e.g. having fewer balls per ball set, smaller ball diameters and/or smaller race diameters—than a conventional ball bearing assembly that has to shoulder all of the load exerted by the anode and/or other rotating components without the aid of magnetic actuators. As a result of being relatively less robust, the ball bearing assembly 246 may be relatively less noisy than a conventional ball bearing assembly.

While the noise generated by a ball bearing assembly can depend on one or more of the factors described above, the noise may alternately or additionally depend on imbalances in the rotating component(s) and/or ball bearing assembly. For instance, a rotating component can have a principle axis of inertia—i.e., an axis the rotating component would tend to rotate around in free space—that may be different than the geometric axis of rotation that the rotating component is constrained to rotate around by the system. Rotation about the geometric axis of rotation rather than the principle axis of inertia results in an imbalance in the rotating component. Imbalances in the rotating component(s) can cause vibrations in the rotating component(s) and/or the ball bearing assembly, which vibrations can generate noise.

According to embodiments of the invention, however, the magnetic actuators 244 magnetically shoulder a portion of the load of the rotating component(s) and allow the rotating component(s) to rotate about or at least closer to its principle axis of inertia. Consequently, the imbalance in the rotating component(s) can be reduced and/or eliminated to reduce and/or eliminate vibrations and/or noise generated by the vibrations.

C. Aspects of Some Active Magnetic Assist Bearing Assemblies

FIG. 2B illustrates one example embodiment of an active MAB assembly 220 that includes means for detecting 248 disposed and coupled between the ball bearing assembly 246 and evacuated enclosure 204. Alternately or additionally, embodiments of the invention can include means for detecting disposed at other locations as well. For instance, with reference to FIG. 2A, means for detecting 248 can alternately or additionally be disposed on the outside of evacuated enclosure 204 and/or coupled between the evacuated enclosure 204 and outer housing 202. Specifically, one or more of means for detecting 248 can be disposed on one or more of the plurality of flanges 226, or in some other location between the evacuated enclosure 204 and outer housing 202.

In this and other embodiments, the means for detecting 248 can detect the load exerted on the MAB assembly 220 by the anode 206 indirectly through the evacuated enclosure 204. In particular, at least a portion of the MAB assembly 220 can be coupled to the evacuated enclosure 204 to allow the load exerted on the MAB assembly 220 to be transferred through the ball bearing assembly 246 to the evacuated enclosure 204 and then to means for detecting 248 coupled between evacuated enclosure 204 and outer housing 202. As such, flexible bellows 272 can be omitted in this and other embodiments to maximize the load transfer from the MAB assembly 220 to the evacuated enclosure 204 by fixedly securing the bearing housing 270 directly to the evacuated enclosure 204.

Furthermore, embodiments of the invention are not limited to means for detecting 248 comprising force sensors that directly or indirectly detect a load on the MAB assembly 220. Indeed, the means for detecting 248 can comprise force sensors, torque sensors, strain sensors, and/or pressure sensors that detect the load on the MAB assembly 220 by generating a signal in response to some form of mechanical stress applied to the sensor.

Alternately or additionally, the means for detecting 248 can comprise distance sensors that detect the load on the MAB assembly 220 by generating signals indicative of the position of at least a portion of the MAB assembly 220 or of the evacuated enclosure 204, or of changes in position of at least a portion of the MAB assembly 220 or of the evacuated enclosure 204, relative to the evacuated enclosure 204 or outer housing 202 or other stationary reference point. As an example, when the bearing housing 270 is flexibly secured to the evacuated enclosure 204 via a flexible bellows 272, for example, the load exerted by the anode 206 on the MAB assembly 220 can cause the position of the ball bearing assembly 246 to change relative to the position of the evacuated enclosure 204. Such changes in position can be detected by means for detecting 248 that can comprise one or more distance sensors, and because the changes in position occur in response to the load exerted by the anode 206 on the MAB assembly 220 through the ball bearing assembly 246, means for detecting 248 can detect the load on the MAB assembly 220 by detecting the position, and/or changes in position, of the ball bearing assembly 246.

Other example embodiments include means for detecting 248 that are configured to detect an orientation or spatial attitude of the x-ray tube 200. As such, the means for detecting 248 can comprise an accelerometer, or the like. In this and other embodiments, the means for detecting 248 detect an orientation or spatial attitude of the x-ray tube 200, whereupon an algorithm is implemented to calculate theoretical loading based on the detected orientation or spatial attitude of x-ray tube 200. The calculated loading can then be used to control the response of the magnetic actuators 244.

In some examples, the means for detecting 248 comprise mechanical-electrical transducers, optical-electrical transducers, or some other type of transducer. As used herein, a transducer refers to a device that converts an input signal of one form to an output signal of another form. For instance, a force-type piezoelectric sensor comprising a mechanical-electrical transducer can convert an applied force to an electrical signal indicative of the force. Analogously, a distance-type sensor comprising an optical-electrical transducer can convert electromagnetic radiation incident on the sensor to an electrical signal indicative of the electromagnetic radiation.

However, means for detecting 248 are not limited to transducer-type sensors. Instead, each of means for detecting 248 can generally include any type of sensor that detects the value or change in value of a parameter indicative of the load exerted on MAB assembly 220 by the anode 206 and converts the value into a signal indicative of the load. The parameters indicative of the load can include a force, torque, strain, or pressure applied to means for detecting 248 by bearing housing 270 in response to the load being exerted on the MAB assembly 220 through the ball bearing assembly 246. Alternately or additionally, the parameters indicative of the load can include the position of the ball bearing assembly 246 and/or the way its position changes in response to the load being exerted on the MAB assembly 220 through the ball bearing assembly 246, and so on.

As another example, the parameters indicative of the load can include the state, e.g., "on" or "off," of one or more electrical contact-type sensors. In this and other embodiments, for example, one or more means for detecting 248 comprising electrical contact-type sensors can be disposed on the bearing housing 270. When each of the means for detecting 248 is not in contact with anything except the surface on which it is disposed, it is in an "off" state. However, when the load on the MAB assembly 220 causes the ball bearing assembly 246 to move relative to the evacuated enclosure 204, one or more of the means for detecting 248 can come in contact with the evacuated enclosure 204, thereby completing an electrical circuit and changing the state of each of the affected means for detecting 248 to "on." The magnetic actuators 244 can then shoulder a portion of the load collectively indicated by all of the means for detecting 248 that happen to be "on" at that time. Shouldering a portion of the load can then cause the ball bearing assembly 246 to move back to a position where all of the means for detecting 248 break contact with the evacuated enclosure 204 and change back to an "off" state.

Finally, embodiments of the invention can further include electronic circuitry for processing the signals that are indicative of the load exerted on the MAB assembly 220 and that are generated by the means for detecting 248. Alternately or additionally, in response to receiving and/or processing the signals indicative of the load, the electronic circuitry can generate control signals for activating the magnetic actuators 244 to shoulder a portion of the load. In some embodiments, the electronic circuitry can comprise a controller or processor, for instance.

III. Second Example Embodiment

Embodiments of the invention are not limited to x-ray tubes, such as the x-ray tube 200 of FIGS. 2A and 2B, that include both an active cooling system for carrying heat away from the anode and an active MAB assembly 220 for rotatably supporting the anode. Indeed, embodiments of the invention include x-ray tubes that include either an active cooling system as described herein, or an active MAB assembly 220, or a combination of the two. For instance, embodiments of the invention are not limited to x-ray tubes at all, but can include other rotating machinery where active cooling is desired and/or reduced noise is desired without the expense of a conventional magnetic bearing assembly. Alternately or additionally, embodiments of the invention can include x-ray tubes or other rotating machinery that implement a passive MAB assembly.

Figure 5B:
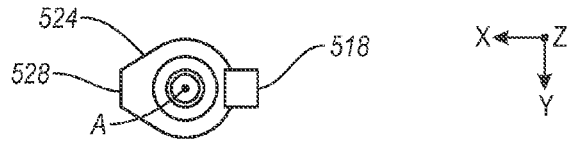
FIG. 5B is a cross-section taken along lines 5B-5B in FIG. 5A.
Figure 5A:
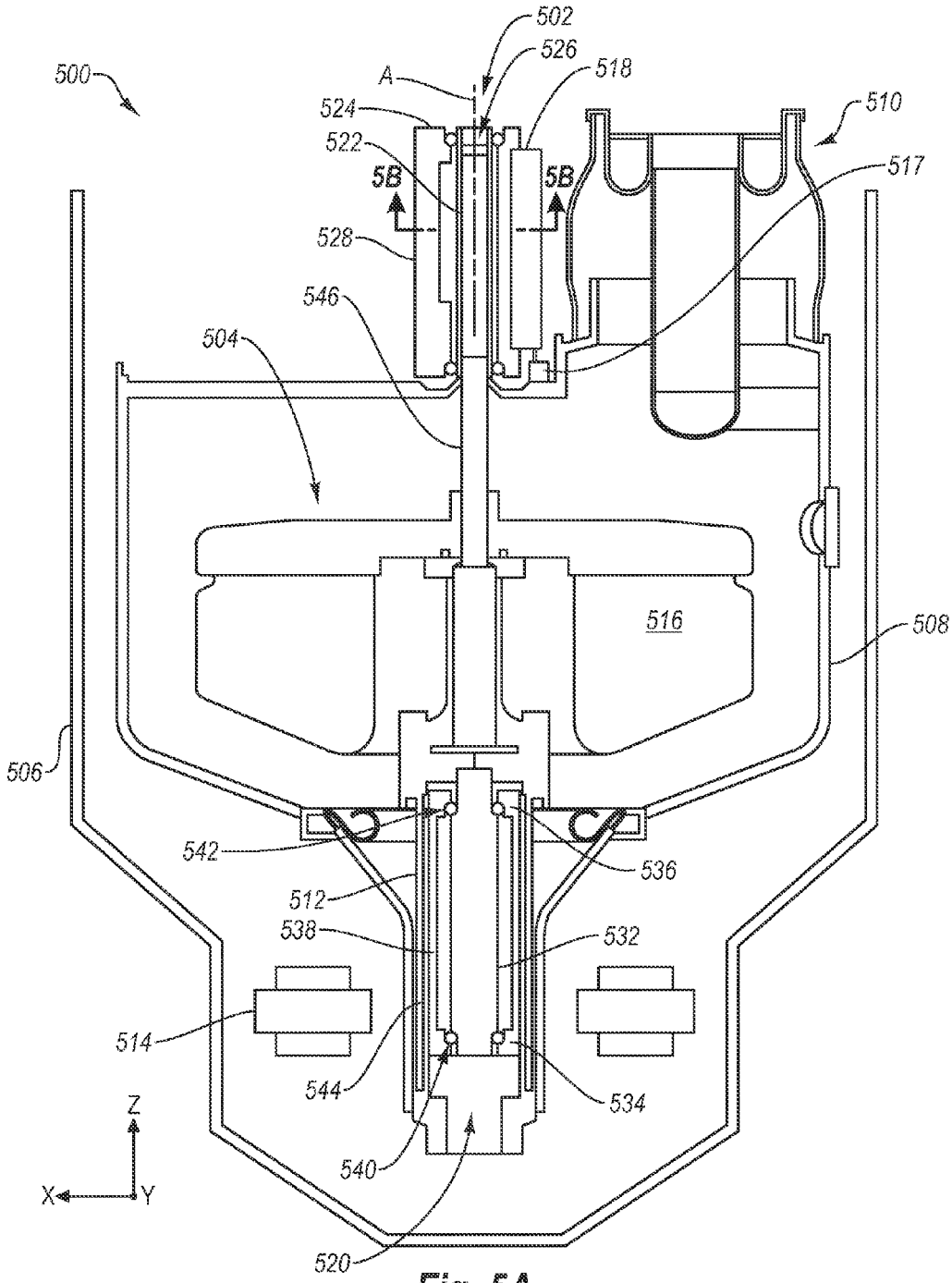
FIG. 5A is a partial cross-sectional view of an x-ray tube according to another embodiment of the invention including a passive magnetic assist bearing assembly.

With additional reference to FIGS. 5A and 5B, one embodiment of an x-ray tube 500 is disclosed that employs a passive MAB assembly 502 to rotatably support an anode 504 and/or other rotating components coupled to the anode 504. FIG. 5A discloses a cross-section of the x-ray tube 500 in a plane parallel to the arbitrarily defined x-z plane, while FIG. 5B discloses a cross-section of a portion of the x-ray tube 500 in a plane parallel to the arbitrarily defined x-y plane.

The x-ray tube 500 of FIGS. 5A and 5B can be similar in some respects to the x-ray tube 200 of FIGS. 2A and 2B and/or can correspond to the x-ray tube 106 of FIG. 1. For instance, as shown in FIG. 5A, x-ray tube 500 includes, in addition to passive MAB assembly 502 and anode 504, an outer housing 506 within which is disposed an evacuated enclosure 508. Disposed within the evacuated enclosure 508 are the anode 504 and a cathode 510. As explained above, the cathode 510 may include a filament that emits electrons that are accelerated towards and impinge upon a focal track of the anode 504 to generate x-rays. The x-ray tube 500 further includes a rotor sleeve 512 coupled to the anode 504, the rotor sleeve 512 being responsive to applied electromagnetic fields such that a rotational motion is imparted to the anode 504.

The passive MAB assembly 502 is at least partially disposed in the evacuated enclosure 508. A portion of the passive MAB assembly 502 is attached to a portion of the evacuated enclosure such that the anode 504 is rotatably supported by the passive MAB assembly 502, thereby enabling the anode 504 to rotate with respect to the evacuated enclosure 508. A stator 514 is disposed about the rotor sleeve 512 and utilizes rotational electromagnetic fields to cause the rotor sleeve 512 to rotate. The rotor sleeve 512 is attached to the anode 504, thereby providing the needed rotation of the anode 504 during x-ray tube 500 operation.

The passive MAB assembly 502 rotatably supports the anode 504 and other rotating components coupled to the anode 504, such as a substrate 516, the rotor sleeve 512, and the like. For simplicity in this disclosure, the passive MAB assembly 502 will be discussed as rotatably supporting the anode 504, with the understanding that the passive MAB assembly 502 also rotatably supports the other rotating components coupled to the anode. 504.

Rotatably supporting the anode 504 can include shouldering a load exerted on the passive MAB assembly 502 by the anode 504 to maintain the anode 504 in a predetermined position within the x-ray tube 500 while allowing the anode 504 to rotate within the x-ray tube 500. The load exerted on the passive MAB assembly 502 by the anode 504 can comprise one or more of axial, radial, and/or torque loads, as explained above with respect to FIGS. 3-4B. As used herein, the passive MAB assembly 502 "shoulders" a load exerted on the passive MAB assembly 502 by the anode 504 by exerting a counteracting force or torque on the anode 504 so as to suspend the anode 504 at a predetermined position within the x-ray tube 500.

As shown in FIG. 5A, in some embodiments, the passive MAB assembly 502 includes one or more permanent magnets 518, a ball bearing assembly 520, and a ferromagnetic shaft 522. The permanent magnet 518 can shoulder a first portion of the load exerted by the anode 504 on the passive MAB assembly 502 during rotation of the anode 504. The ball bearing assembly 520 can stabilize the anode 504, shouldering a remaining portion of the load exerted by the anode 504 on the passive MAB assembly 502 that is not shouldered by the permanent magnet 518. The ferromagnetic shaft 522 is coupled to the anode 504 and allows magnetic forces exerted by the permanent magnet 518 to act on the anode 504 through the ferromagnetic shaft 522. In some embodiments, each of the permanent magnet 518 and ball bearing assembly 520 shoulders a substantial portion of the load.

Alternately or additionally, in some embodiments, the permanent magnet 518 shoulders most of the load exerted by the anode 504 on the passive MAB assembly 502 during rotation of the anode 504. In other embodiments, the ball bearing assembly 520 shoulders most of the load exerted by the anode 504 on the passive MAB assembly 502 during rotation of the anode 504. In yet other embodiments, the portions of the load shouldered by the permanent magnet 518 and ball bearing assembly 520 are substantially equal. Accordingly, embodiments of the invention cover a wide range of load shouldering responsibilities between the permanent magnet 518 and the ball bearing assembly 520.

Because the permanent magnet 518 shoulders a portion of the load exerted on the passive MAB assembly 502 by the anode 504, the ball bearing assembly 520 can be relatively smaller and quieter than a ball bearing assembly configured to support equivalent loads without the aid of a permanent magnet. Additionally, use of the ball bearing assembly 520 to shoulder a portion of the load and/or to stabilize the anode 504 and use of permanent magnet 518 to shoulder a remaining portion of the load exerted by the anode 504 on the passive MAB assembly 502 eliminates the need for costly sensors and feedback circuits employed in conventional magnetic bearing assemblies.

In more detail, the permanent magnet 518 can be secured to the evacuated enclosure 508. Permanent magnet 518 can be disposed proximate the ferromagnetic shaft 522 so as to exert forces on the anode 504 through the ferromagnetic shaft 522 in order to shoulder a portion of the load exerted by the anode 504 on the passive MAB assembly 502.

The permanent magnet 518 can comprise materials including, but not limited to, ferrite, alnico, iron, nickel, cobalt, neodymium, samarium, and the like or any combination thereof Further, although the passive MAB assembly 502 is disclosed as having a single permanent magnet 518 in the present example, in other examples the passive MAB assembly 502 can have two or more permanent magnets.

In some embodiments, the permanent magnet 518 is disposed alongside the ferromagnetic shaft 522 at some radial separation from the ferromagnetic shaft 522 so as to at least shoulder radial loads. Accordingly, when the x-ray tube 500 is oriented such that an axis of rotation A of the anode 504 is substantially perpendicular to the earth's gravitational field such that the weight of the anode 504 is substantially directed downwards and substantially parallel to the x-y plane, the permanent magnet 518 can exert a substantially upwards directed radial magnetic force on the ferromagnetic shaft 522 in a direction substantially parallel to the x-y plane to shoulder a portion of the weight of the anode 504.

Alternately or additionally, in some applications, such as in the CT scanner 100 of FIG. 1, the orientation of the anode 504 can change as the x-ray tube 500 rotates around gantry 102. As a result of the changing orientation of the anode 504, the direction and/or magnitude of the loads exerted by the anode 504 on the passive MAB assembly 502 can change, as explained above with respect to FIGS. 3-4B. To accommodate the changing direction and/or magnitude of the loads exerted by the anode 504 on the passive MAB assembly 502, the passive MAB assembly 502 can additionally include a rotatable housing 524 coupled between the permanent magnet 518 and the evacuated enclosure 508, as best seen in FIGS. 5A and 5B.

In this and other embodiments, the rotatable housing 524 can be configured to rotate about an axis of rotation that is substantially collinear with an axis of rotation of the ferromagnetic shaft 522 and/or with the axis of rotation A of the anode 504. To that end, the rotatable housing 524 can incorporate a light-duty ball bearing assembly 526, for example. Further, the rotatable housing 524 can include a weighted side 528. The ability of the rotatable housing 524 to rotate about the axis A and the inclusion of the weighted side 528 can allow the rotatable housing 524 to be responsive to gravitational fields so as to orient the permanent magnet 518 in such an orientation as to at least partially counteract gravitational fields acting on the anode 504. In particular, in an example of FIGS. 5A and 5B where the earth's gravitational field exerts downward forces in the positive x-direction, the rotatable housing 524 can respond to earth's gravitational field by rotating so that the weighted side 528 is oriented downwards, thereby orienting the permanent magnet 518 upwards where the permanent magnet 518 can exert a magnetic force on the ferromagnetic shaft 522 that includes an upwards directed force.

In the example of FIGS. 5A and 5B, the rotatable housing 524 has been discussed as being responsive to the earth's gravitational field. However, the rotatable housing 524 can alternately or additionally be responsive to other gravitational fields, including pseudo-gravitational fields. As used herein, a "pseudo-gravitational field" refers to an imaginary gravitational field that appears to act on an object in an inertial frame of reference of the object. For example, when the x-ray tube 500 is implemented in a CT scanner or other rotating application, the rotation of the x-ray tube 500 about a gantry axis results in a centrifugal force acting on the x-ray tube 500 in the x-ray tube's 500 inertial frame of reference. The centrifugal force acting on the x-ray tube 500 essentially "feels" like the earth's gravity and is one manifestation of a pseudo-gravitational field that can act on the x-ray tube 500, and accordingly, on the rotatable housing 524.

In any event, the orientation of the permanent magnet 518 can be adjusted in some embodiments to accommodate the changing direction and/or magnitude of the loads exerted by the anode 504 on the passive MAB assembly 502. Further, the changing direction and/or magnitude of the loads can be accommodated without the use of the sensors and feedback circuitry required for conventional magnetic bearing assemblies. Alternately or additionally, the passive MAB assembly 502 can incorporate one or more sensors, feedback circuits, or electronic actuators to reposition the permanent magnet 518 so as to accommodate the changing direction and/or magnitude of the loads exerted by the anode 504.

For example, in some embodiments, the passive MAB assembly 502 incorporates one or more pneumatic and/or hydraulic actuators or other means for repositioning the permanent magnet 518 ("repositioning means"), denoted at 517 in FIG. 5A, to move the permanent magnet 518 axially along the axis A so as to reposition the permanent magnet 518 at a greater or lesser distance from the anode 504 than is illustrated in FIG. 5A. Alternately or additionally, the MAB assembly 502 incorporates one or more sensors allowing the MAB assembly 502 to detect the orientation of the anode 504. Thus, depending on the orientation of the anode 504, the permanent magnet 518 can be repositioned axially using repositioning means, such that the permanent magnet 518 exerts a force on the ferromagnetic shaft 522 that includes an axial or "z" component.

In some embodiments, the permanent magnet 518 combined with the ferromagnetic shaft 522 reduces the portion of the load exerted directly on the ball bearing assembly 520 by shouldering a portion of the load exerted by the anode 504 on the passive MAB assembly 502. In particular, because the permanent magnet 518 shoulders a portion of the load exerted by the anode 504 on the passive MAB assembly 502, less than all of the load exerted by the anode 504 on the passive MAB assembly 502 remains to be shouldered by the ball bearing assembly 520. Accordingly, the ball bearing assembly 520, which can be coupled directly to the anode 504, stabilizes the anode 504 and/or other rotating components during rotation of the anode 504 and/or other rotating components, such that the permanent magnet 518 does not have to rigorously levitate the anode 504 and/or other rotating components to a precise tolerance. As used herein, "stabilizing the anode 504" can include shouldering less than all of the load and/or reacting quickly to small load changes exerted by the anode 504 on the passive MAB assembly 502 to maintain the anode 504 at a predetermined position, within tight tolerances, within the x-ray tube 500.

The ball bearing assembly 520 can be similar in some respects to the ball bearing assembly 246 of FIGS. 2A-2B and reference may be made above for a complete description. Briefly, however, the ball bearing assembly 520 includes a shaft 532, lower bearing ring 534, upper bearing ring 536, spacer 538, lower ball set 540, upper ball set 542, and a bearing housing 544. The shaft 532 is coupled to the anode 504 and/or rotor sleeve 512. The shaft 532, lower bearing ring 534 and upper bearing ring 536 cooperate to define lower and upper bearing races that confine lower ball set 540 and upper ball set 542, respectively. The lower ball set 540 and upper ball set 542 cooperate to facilitate high-speed rotary motion of the shaft 532, and thus of the anode 504. The bearing housing 544 can be coupled to the evacuated enclosure 508 and serves to receive and securely retain lower and upper bearing rings 534 and 536, lower and upper ball sets 540 and 542, as well as at least a portion of shaft 532. Although not shown, in some embodiments, a flexible bellows, such as the flexible bellows 272, can be coupled between the bearing housing 544 and evacuated enclosure 508 analogous to the configuration shown in FIG. 2B.

According to some embodiments of the invention, the permanent magnet 518 essentially provides the brute force to maintain the anode 504 within the general area of a predetermined position within the x-ray tube 500. At the same time, by virtue of being directly coupled to the anode 504, the ball bearing assembly 520 can stabilize the anode 504, which can include reacting quickly to small load changes exerted by the anode 504 on the passive MAB assembly 502 to maintain the anode 504 at the predetermined position, within tight tolerances, within the x-ray tube 500.

Further, the ball bearing assembly 520 is configured to generate relatively less noise than a ball bearing assembly that can, by itself, shoulder a load equivalent to that shouldered by the passive MAB assembly 502. The ability of the ball bearing assembly 520 to generate relatively less noise relates to the fact that the permanent magnet 518 shoulders a portion of the load, allowing the ball bearing assembly 520 to be relatively less robust, e.g. having fewer balls per ball set, smaller ball diameters and/or smaller race diameters, than a conventional ball bearing assembly that has to shoulder all of the load exerted by the anode without the aid of permanent magnets.

In some embodiments of the invention, the ferromagnetic shaft 522 can be coupled directly to the anode 504 and can have an axis of rotation that is substantially collinear with the axis of rotation A of the anode 504. Alternately or additionally, the passive MAB assembly 502 can include a substantially rigid shaft 546 coupled between the ferromagnetic shaft 522 and the anode 504. The substantially rigid shaft 546 can comprise, for example, a zirconium oxide ("ZrO2") ceramic rod or other suitable material(s). Alternately or additionally, the substantially rigid shaft 546 can comprise a substantially thermally insulating material, a substantially electrically insulating material, or both.

In some x-ray tube designs, the anode operates at a high electrical potential relative to ground potential. Accordingly, the use of a substantially rigid shaft 546 that is substantially electrically insulating can allow the passive MAB assembly 502 to operate at ground potential or at some other electrical potential that is different than the electrical potential of the anode 504. Alternately or additionally, the x-ray tube can comprise an anode-grounded x-ray tube, in which case the substantially rigid shaft 546 need not be substantially electrically insulating and/or may be omitted entirely.

When the substantially rigid shaft 546 is substantially thermally insulating, the substantially rigid shaft 546 can act as a heat choke between the anode 504 and the ferromagnetic shaft 522. In particular, the impingement of electrons emitted by the cathode 510 on the anode 504 can generate a significant amount of heat, which may be as much as 1700° C. or more in some embodiments. The use of a substantially rigid shaft 546 that is substantially thermally insulating can substantially prevent the high operating temperatures of the anode 504 from being conductively transferred to the ferromagnetic shaft 522, which high operating temperatures may otherwise exceed the Curie point of the ferromagnetic shaft 522 and cause the ferromagnetic shaft 522 to lose its characteristic ferromagnetic ability.

IV. Third Example Embodiment

Figure 6:
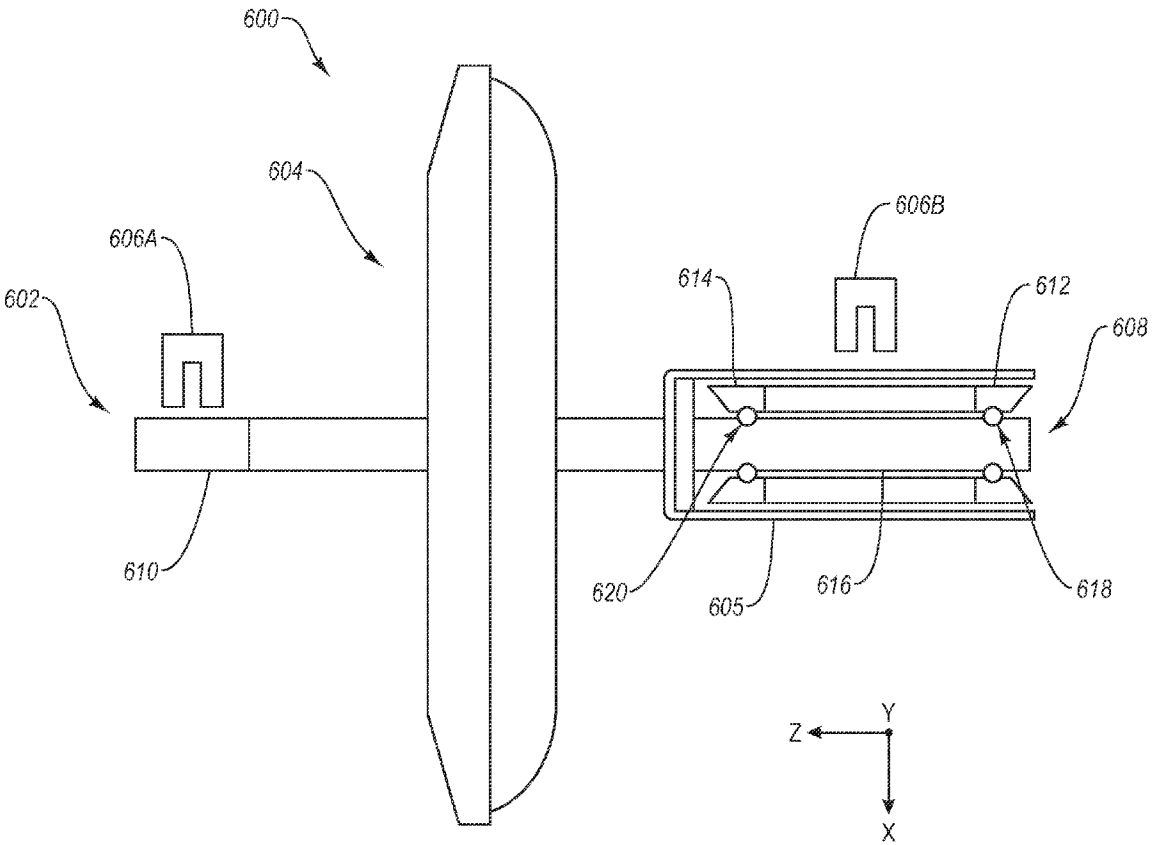
FIG. 6 is a partial cross-sectional view of an x-ray tube according to yet another embodiment of the invention including a passive magnetic assist bearing assembly.

Turning next to FIG. 6, one embodiment of an x-ray tube 600 is disclosed that employs a passive MAB assembly 602 to rotatably support an anode 604 and/or other rotating components coupled to the anode 604. The x-ray tube 600 can be similar in some respects to the x-ray tube 500 and/or can correspond to the x-ray tube 106 of FIG. 1. Although not shown in FIG. 6, the x-ray tube 600 can include an outer housing within which is disposed an evacuated enclosure. The anode 604, a cathode (not shown) and a rotor sleeve 605 can be disposed within the evacuated enclosure.

The passive MAB assembly 602 is at least partially disposed in the evacuated enclosure of the x-ray tube 600. A portion of the passive MAB assembly 602 is attached to a portion of the evacuated enclosure such that the anode 604 is rotatably supported by the passive MAB assembly 602, thereby enabling the anode 604 to rotate with respect to the evacuated enclosure of the x-ray tube 600.

Similar to the passive MAB assembly 502 of FIG. 5A, the passive MAB assembly 602 of FIG. 6 can include one or more permanent magnets 606A, 606B, a ball bearing assembly 608, and a ferromagnetic shaft 610. The permanent magnets 606A, 606B can shoulder a portion of the load exerted by the anode 604 on the passive MAB assembly 602 during rotation of the anode 604. The ball bearing assembly 608 can stabilize the anode 604, shouldering a remaining portion of the load exerted by the anode 604 on the passive MAB assembly 602 that is not shouldered by the permanent magnets 606A, 606B. The ferromagnetic shaft 610 is coupled to the anode 604 and allows magnetic forces exerted by the permanent magnet 606A to act on the anode 604 through the ferromagnetic shaft 610.

In some embodiments, the rotor sleeve 605 comprises a ferromagnetic material and is coupled to the anode 604. The rotor sleeve 605 allows magnetic forces exerted by the permanent magnet 606B to act on the anode 604 through the rotor sleeve 605.

The ball bearing assembly 608 will not be discussed in detail as it is similar to the ball bearing assemblies 246 and 520 of FIGS. 2B, 5A and 5B in some examples. Briefly, for instance, the ball bearing assembly 608 can include a lower ring 612, upper ring 614, shaft 616, spacer (not shown), lower and upper ball sets 618, 620, and a bearing housing (not shown).

The permanent magnets 606A, 606B can be positioned outside the evacuated enclosure of the x-ray tube 600. In some cases, the permanent magnets 606A, 606B are U-shaped so as to more effectively confine magnetic fields of the permanent magnets 606A, 606B locally compared to cube- or box-shaped permanent magnets.

Although not shown, each of the permanent magnets 606A, 606B can be mounted to a rotatable housing, such as the rotatable housing 524 of FIGS. 5A and 5B, that can rotate about an axis that is substantially collinear with the axis of rotation of the anode 604. Further, the rotatable housings to which the permanent magnets 606A, 606B are mounted can include weighted sides or can otherwise be configured to allow the rotatable housings to be responsive to gravitational fields so as to orient the permanent magnets 606A, 606B in such an orientation as to at least partially counteract gravitational fields acting on the anode 604. In this manner, the passive MAB assembly 602 can accommodate the changing direction and/or magnitude of loads exerted by the anode 604 on the passive MAB assembly 602 as the orientation of the anode 604 is changed during operation.

Alternately or additionally, the permanent magnets 606A, 606B and/or the rotatable housings to which the permanent magnets 606A, 606B are attached can be moved axially relative to the anode 604 to alter the magnitude and/or direction of the magnetic forces exerted by the permanent magnets 606A, 606B on the anode 604 via the ferromagnetic shaft 610 and rotor sleeve 605.

Various embodiments have been disclosed that include active MAB assemblies comprising one or more magnetic actuators and a ball bearing assembly and passive MAB assemblies comprising one or more permanent magnets and a ball bearing assembly. Alternately or additionally, embodiments of the invention include MAB assemblies comprising a ball bearing assembly, one or more magnetic actuators, and one or more permanent magnets.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An x-ray tube, comprising:

an evacuated enclosure;

a cathode disposed within the evacuated enclosure;

an anode disposed within the evacuated enclosure opposite the cathode so as to receive electrons emitted by the cathode;

a rotor sleeve coupled to the anode, the rotor sleeve being responsive to applied electromagnetic fields such that a rotational motion is imparted to the anode;

a magnetic assist bearing assembly rotatably supporting the anode; and an active cooling system at least partially disposed within a cavity formed in the anode.

2. The x-ray tube of claim 1, wherein the magnetic assist bearing assembly comprises a passive magnetic assist bearing assembly, including:

a ball bearing assembly stabilizing the anode during rotation of the anode, the rotor sleeve being disposed about the ball bearing assembly;

a ferromagnetic shaft coupled to the anode and having an axis of rotation that is substantially collinear with an axis of rotation of the anode; and a permanent magnet utilizing a magnetic field to shoulder a substantial portion of a load exerted by the anode on the passive magnetic assist bearing assembly.

3. The x-ray tube of claim 1, wherein the magnetic assist bearing assembly comprises an active magnetic assist bearing assembly, including:

a ball bearing assembly stabilizing the anode during rotation of the anode, the rotor sleeve being disposed about the ball bearing assembly;

means for detecting a load exerted on the ball bearing assembly by the anode during rotation of the anode; and one or more magnetic actuators disposed about the rotor sleeve and shouldering a substantial portion of the detected load.

4. The x-ray tube of claim 3, further comprising an outer enclosure within which the evacuated enclosure is disposed, wherein the means for detecting comprise one or more sensors coupled between the evacuated enclosure and the outer enclosure.

5. The x-ray tube of claim 3, wherein the ball bearing assembly comprises:

a shaft coupled to the anode;

one or more bearing rings cooperating with the shaft to define one or more races;

one or more ball sets, each ball set disposed in a corresponding one of the one or more races; and a bearing housing configured to receive the one or more bearing rings, the one or more ball sets, and a portion of the shaft.

6. The x-ray tube of claim 5, wherein the evacuated enclosure cooperates with the bearing housing to maintain the cathode, anode, rotor sleeve, shaft, one or more bearing rings and one or more ball sets in a substantial vacuum.

7. The x-ray tube of claim 6, wherein the means for detecting comprise one or more sensors coupled between the evacuated enclosure and the bearing housing.

8. The x-ray tube of claim 1, wherein the active cooling system is at least partially disposed within the evacuated enclosure and thermally coupled to the anode via a liquid metal interface disposed between the active cooling system and the anode.

9. The x-ray tube of claim 8, wherein the liquid metal interface comprises one or more of: gallium, indium, tin, or gallium eutectic.

10. An active magnetic assist bearing assembly, comprising:

a ball bearing assembly comprising a shaft coupled to a component configured to rotate, the ball bearing assembly shouldering a first portion of a load exerted by the component on the active magnetic assist bearing assembly during rotation of the component;

means for detecting the load exerted on the active magnetic assist bearing assembly by the component;

one or more magnetic actuators disposed about a rotor sleeve coupled to the component, the one or more magnetic actuators shouldering a second portion of the load during rotation of the component; and a cooling shaft extending into a cavity defined by the component, the cooling shaft including a plurality of channels configured to allow a coolant to circulate therein.

11. The active magnetic assist bearing assembly of claim 10, wherein the means for detecting comprise one or more sensors disposed between the ball bearing assembly and an evacuated enclosure in which the component and at least a portion of the active magnetic assist bearing assembly are disposed.

12. The active magnetic assist bearing assembly of claim 10, wherein the means for detecting comprise one or more piezoelectric transducers.

13. The active magnetic assist bearing assembly of claim 10, wherein the means for detecting comprise one or more of: a force sensor, a torque sensor, a strain sensor, a pressure sensor, or a distance sensor, and wherein the force, torque, strain, pressure, or distance that is sensed by the sensor is indicative of the load.

14. The active magnetic assist bearing assembly of claim 10, wherein the ball bearing assembly further comprises:

one or more bearing rings cooperating with the shaft to define one or more races;

one or more ball sets, each ball set disposed in one of the one or more races; and a bearing housing configured to receive the one or more bearing rings, the one or more ball sets, and a portion of the shaft.

15. The active magnetic assist bearing assembly of claim 14, further comprising a flexible bellows coupled between the bearing housing and an evacuated enclosure in which the component and at least a portion of the magnetic assist bearing assembly are disposed, the flexible bellows allowing the load exerted on the magnetic assist bearing assembly to be transferred through the ball bearing assembly to the means for detecting.

16. An x-ray tube, comprising:

an evacuated enclosure;

a cathode disposed within the evacuated enclosure;

an anode disposed within the evacuated enclosure opposite the cathode so as to receive electrons emitted by the cathode, the anode defining a cavity extending from a top of the anode towards a bottom of the anode and substantially centered about a geometric axis of rotation of the anode;

a rotor sleeve coupled to the anode, the rotor sleeve being responsive to applied electromagnetic fields such that a rotational motion is imparted to the anode; and an active cooling system at least partially disposed within the evacuated enclosure, the active cooling system comprising a cooling shaft extending into the cavity defined by the anode.

17. The x-ray tube of claim 16, further comprising a magnetic assist bearing assembly rotatably supporting the anode.

18. The x-ray tube of claim 17, wherein the magnetic assist bearing assembly comprises an active magnetic assist bearing assembly or a passive magnetic assist bearing assembly.

19. The x-ray tube of claim 16, further comprising a liquid metal interface disposed between the anode and the cooling shaft and facilitating heat transfer from the anode to the cooling shaft.

20. The x-ray tube of claim 19, wherein the liquid metal interface comprises gallium eutectic.

21. The x-ray tube of claim 16, further comprising a substrate coupled to the anode and providing conductive heat transfer from the anode to the cooling shaft.

22. The x-ray tube of claim 16, further comprising a plurality of channels formed in the cooling shaft and a cooling fluid circulating through the channels to carry heat away from the anode.

23. A passive magnetic assist bearing assembly, comprising:

a ball bearing assembly comprising a shaft coupled to a component configured to rotate, the ball bearing assembly shouldering a first portion of a load exerted by the component on the passive magnetic assist bearing assembly during rotation of the component;

a ferromagnetic shaft coupled to the component and having an axis of rotation that is substantially collinear with an axis of rotation of the component; and one or more permanent magnets spaced apart from the ferromagnetic shaft and so as to be positioned on a side of the component that is opposite to the ball bearing assembly, the one or more permanent magnets utilizing magnetic fields to exert magnetic forces on the ferromagnetic shaft to shoulder a second portion of the load during rotation of the component.

24. The passive magnetic assist bearing assembly of claim 23, wherein the component comprises an anode disposed within an evacuated enclosure, the one or more permanent magnets being disposed external to the evacuated enclosure.

25. The passive magnetic assist bearing assembly of claim 23, further comprising a rotatable housing to which the permanent magnet is attached, the rotatable housing being responsive to gravitational fields so as to orient the permanent magnet in such an orientation as to at least partially counteract gravitational fields acting on the component.

26. The passive magnetic assist bearing assembly of claim 23, wherein at least one of the permanent magnets is selectively movable in a direction that is substantially parallel to the axis of rotation of the component.

27. The passive magnetic assist bearing assembly of claim 26, further comprising a pneumatic actuator or a hydraulic actuator moving the at least one of the permanent magnets in the direction that is substantially parallel to the axis of rotation of the component.

28. The passive magnetic assist bearing assembly of claim 23, further comprising a substantially rigid shaft coupled at one end to an end of the ferromagnetic shaft and at another end to the component so as to be positioned between the ferromagnetic shaft and the component, the substantially rigid shaft being substantially thermally insulating and substantially electrically insulating.

* * * * *